US009592616B2

(12) United States Patent
Clark

(10) Patent No.: US 9,592,616 B2
(45) Date of Patent: Mar. 14, 2017

(54) KNIFE THAT RELIEVES PRESSURE ON METACARPOPHALANGEAL JOINT OF INDEX FINGER

(71) Applicant: Robert Clark, Lutherville, MD (US)

(72) Inventor: Robert Clark, Lutherville, MD (US)

( * ) Notice: Subject to any disclaimer, the term of this patent is extended or adjusted under 35 U.S.C. 154(b) by 294 days.

(21) Appl. No.: 13/826,946

(22) Filed: Mar. 14, 2013

(65) Prior Publication Data

US 2014/0259696 A1 Sep. 18, 2014

(51) Int. Cl.
*B26B 3/02* (2006.01)
*B26B 29/02* (2006.01)

(52) U.S. Cl.
CPC ..... *B26B 29/02* (2013.01); *Y10T 29/49* (2015.01)

(58) Field of Classification Search
CPC .. B26B 9/00; B26B 29/02; B26B 1/00; B26B 11/03; B26B 3/03; Y10T 29/49
USPC ..... 30/312–313
See application file for complete search history.

(56) References Cited

U.S. PATENT DOCUMENTS 4,885,818 A 12/1989 Arterbury
5,398,360 A * 3/1995 Alexander ..... B26B 3/06 30/143
5,495,670 A 3/1996 Quinn
D389,717 S * 1/1998 Burnett ..... D8/99
6,381,855 B1 * 5/2002 Lin ..... B26B 29/02 30/286
6,598,302 B1 7/2003 Peppel et al.
6,658,743 B2 12/2003 Dudley, Jr. et al.
7,434,320 B2 10/2008 Aston, III
8,707,490 B1 * 4/2014 Pelton ..... B26B 1/00 30/123
2005/0229401 A1 * 10/2005 Onion ..... 30/161
2005/0246903 A1 * 11/2005 Yeager ..... B26B 3/00 30/329
2012/0159793 A1 * 6/2012 Hatch ..... B26B 29/02 30/312
2013/0312270 A1 * 11/2013 Gutierrez ..... B26B 1/04 30/161

* cited by examiner

*Primary Examiner* — Jonathan Riley
*Assistant Examiner* — Liang Dong
(74) *Attorney, Agent, or Firm* — Pamela K. Riewerts, Esq.; Larry J. Guffey, Esq.; Oliver & Grimsley, LLC

(57) ABSTRACT

A knife for relieving pressure on the index finger metacarpophalangeal joint of one using the knife by pressing down with the index finger on a top portion of the knife, comprising a handle having a top and bottom portion and two opposing sides and a proximal and distal end, a blade having a top portion and bottom, cutting edge portion and two opposing sides and a proximal and distal end and configured so the handle and blade overlap and the blade proximal end is connected to the handle distal end, a finger rest having a top and front portion and is connected to the blade at a point proximate the proximal end of the blade, and wherein the finger rest, handle and blade are configured to minimize pressure on the index finger metacarpophalangeal joint of one using the knife by pressing down with the index finger on the finger rest.

12 Claims, 8 Drawing Sheets

KNIFE THAT RELIEVES PRESSURE ON METACARPOPHALANGEAL JOINT OF INDEX FINGER

BACKGROUND OF THE INVENTION

1. Field of the Invention

The present invention relates generally to the general field of cutlery. More particularly, the invention disclosed herein relates to knives and relieving pressure on finger joints.

2. Description of the Related Art

The present invention is particularly applicable to the culinary industry and to one who typically uses knives for cutting or performs a repeated cutting motion and will be described with particular reference thereto.

The continuing concern among those in the culinary industry and among routine knife users is relieving pressure on the metacarpophalangeal joint of the index finger of one who is using a knife for cutting, and who is pressing down with the underside of the user's index finger on a top portion of a knife. Over a period of time, the pressure applied to the metacarpophalangeal joint of the index finger will cause a user of a knife to experience joint stress, strain on the bone, and arthritis. This affects the hand of the user of the knife and greatly impacts use of the hand through everyday living.

The prior art teaches various types of gripping handles for use with various types of tools or implements. These gripping handles provide a grasping surface for manipulation and allow an intended user to manually use the tool for its intended use or function.

Various types of grips exist for a user to engage a knife to perform a cutting motion. Most, if not all, of these grips involve activity of the finger joints, namely, the metacarpophalangeal joint of the index finger. When the hand that is engaging the knife is tightly clasped, for example, the muscles of the hand remain in tension and the muscles and metacarpophalangeal joint of the index finger are tightly compressed.

The goal of any handle or grip is to promote efficiency such that the hand is maintained in a comfortable position, and also to avoid placing substantial external pressure and internal pressure on the hand, fingers, or finger joints. Moreover, a further goal is to facilitate the function of the hand, muscles and fingers as they work together to perform a cutting motion.

Conventional implement gripping handles suffer from a number of drawbacks. One such drawback is that conventional handles typically only allow the use of a hand to grip the knife such that the finger digits maintain the handle against the palm of the hand.

In situations requiring both power and precision, such as during various types of culinary operations, precision using conventional handles is typically achieved at the cost of excessive compensation by the hand, wrist and arm of the operator with resultant potential risk for various types of injuries, including repetitive stress-type injuries.

Another common drawback associated with conventional gripping handles is that they typically do not fit the hand well, allowing only a limited surface area of the hand to contact the gripping handle. A user is hence required to exert a greater amount of strength to adequately grip the handle and perform a given task. Furthermore, this creates high pressure points on the small portion of the hand contacting the gripping handle, which again potentially leads to injuries.

Another drawback associated with conventional gripping handles is that they are poorly designed for certain types of movement such as sawing, slicing, or cutting. In addition, conventional handles poorly conform to the configuration of the index finger, and, hence, the external force applied when the knife user presses down on the knife in a cutting motion may quickly lead to discomfort and/or injury.

More recently, ergonomic handles on implements have been introduced to the culinary industry. Ergonomic handles usually are curved and may contain bumps or finger grooves within the handle so that the handle fits smoothly into the hand and clasped fingers of the user. Ergonomic handles help to maintain the natural arcs of the fingers and palm for the natural accommodation of the hand, which enables the hand to conform to the handle. In conforming to the natural hand anatomy, a handle of this design becomes more comfortable for the user to hold or rest his hand on, and may aid some users with a more stable, secure and comfortable grip. Some ergonomic handles allow for the fingers to be flexed separately at the metacarpophalangeal joint according to the normal physiological flexed alignment of the user's hand.

Even with ergonomic knives, however, the user feels pressure in the metacarpophalangeal joint of the user's index finger. Due to the flexed nature of the index finger during cutting, pressure is still applied on the user's metacarpophalangeal joint when the user initiates a downward cutting force on the knife. Consequently, those in the culinary profession or routine knife users continue to experience pressure, injury, and arthritis in their cutting hand, and more particularly, in the metacarpophalangeal joint of each user's index finger.

Those in the culinary profession or routine knife users usually spend continuous amounts of time cutting food or other materials. When using a knife to perform a cutting motion, the user applies pressure to the knife in a substantially downward fashion. This force, in turn, impacts the metacarpophalangeal joint of the user's index finger. With continuous, repeated use of the knife in a single session, the stress on the metacarpophalangeal joint leads to injury and pain, including arthritis, and therefore impacts and disrupts the user's culinary practice or routine use of the knife implement.

Despite the existence of many types of culinary handles to facilitate the function of the hand and relieve repeated stress and injury to the user's hand and fingers during cutting, the culinary industry and routine knife users continue to experience pressure on the metacarpophalangeal joint of the user's index finger.

Accordingly, there is a need for a new and improved knife that specifically relieves the pressure experienced by a knife user on the metacarpophalangeal joint of the user's index finger as the user performs a cutting motion. In addition, there is a need for a knife that provides better and more advantageous overall results in terms of extending the length of time a user is able to comfortably perform a cutting motion, and of the ability of a user to utilize the knife over time. It is a general object of the present invention to provide such an improved knife.

SUMMARY OF THE INVENTION

Recognizing the need for the development of new and improved methods and products for relieving pressure on the metacarpophalangeal joint of the index finger of a user performing a repetitive cutting motion with a knife, the present invention is generally directed to the needs set forth above and overcoming the problems with and disadvantages exhibited by prior knives and handles.

The present invention relates to a knife that is configured to relieve the pressure on the metacarpophalangeal joint of the index finger of one who is using the knife for cutting by resting and pressing down with the underside of the index finger on a top portion of the knife, wherein the knife comprises: (a) a handle having a top and a bottom portion and two opposing sides and a proximal and a distal end and a longitudinal centerline therebetween, (b) a blade having a top portion and a bottom, cutting edge portion and two opposing sides and a proximal and a distal end and a longitudinal centerline therebetween and configured such that at least a portion of the handle and blade longitudinal centerlines overlap each other and the blade proximal end is connected to and extends from the distal end of the handle, (c) a finger rest having a top and a front portion and is connected to the blade at a point proximate the proximal end of the blade, and (d) wherein the finger rest, handle and blade are configured and situated relative to each other so as to minimize the pressure on the metacarpophalangeal joint of the index finger of one who uses the knife for cutting by resting and pressing down with the underside of the index finger on the top portion of the finger rest.

In other possible embodiments of the present invention: (e) the finger rest could be further configured so as to allow the index finger to wrap around the front portion of the finger rest, (f) the handle could be further configured so as to allow the underside of the middle, ring and small fingers to substantially wrap around one side and the bottom of the handle while the distal phalange of the thumb is held adjacent the opposing side of the handle, (g) the finger rest could be further configured to have a substantially tubular shape that extends approximately perpendicular to a side of the blade, and (h) the finger rest could be further configured to have a substantially tubular shape and to have two components, each of which extends approximately perpendicular from one of the sides of the blade.

In addition, the present invention can take the form of a method of forming a knife that relieves the pressure on the metacarpophalangeal joint of the index finger of one who is using the knife for cutting by resting and pressing down with the underside of the index finger on a top portion of the knife, wherein the method includes: (a) providing a handle having a top and a bottom portion and two opposing sides and a proximal and a distal end and a longitudinal centerline therebetween, (b) providing a blade having a top portion and a bottom, cutting edge portion and two opposing sides and a proximal and a distal end and a longitudinal centerline therebetween and configured such that at least a portion of said handle and blade longitudinal centerlines overlap each other and the blade proximal end is connected to and extends from the distal end of the handle, (c) providing a finger rest having a top and a front portion and that is connected at a location selected from the group consisting of proximate to the proximal end of the blade or proximate to the distal end of the handle or a location therebetween, and (d) wherein the finger rest, handle and blade are configured and situated relative to each other so as to minimize the pressure on the metacarpophalangeal joint of the index finger of one who uses the knife for cutting by resting and pressing down with the underside of the index finger on the top portion of the finger rest.

Thus, there has been summarized above (rather broadly and understanding that there are other preferred embodiments which have not been summarized above) the present invention in order that the detailed description that follows may be better understood and appreciated.

DESCRIPTION OF THE PREFERRED EMBODIMENT

Figure 1:
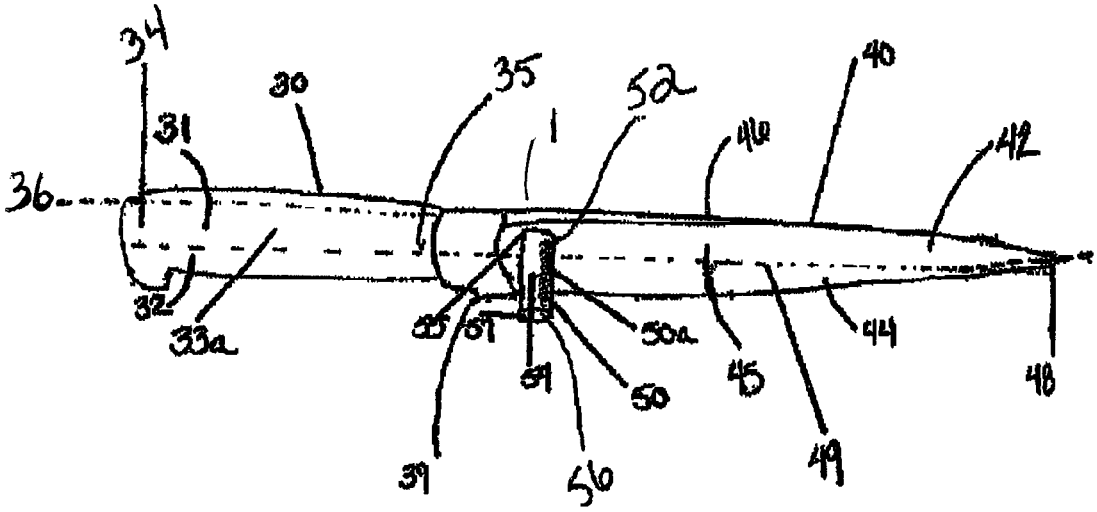
FIG. 1 is a perspective, elevational view that illustrates a preferred embodiment of the present invention with a finger rest on one side of the knife.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Referring to FIG. 1, there is illustrated a preferred embodiment of the present invention 1 in the form of an improved knife 1 that relieves the pressure on the metacarpophalangeal joint 16 of the index finger 14 of one who is using the knife for cutting by resting and pressing down with the underside 15 of the user's index finger on a top portion of the knife, including the handle 30 and blade 40. Use of the knife is particularly suited for cutting, chopping, slicing, sawing, and similar functions related to all types of food items or the like, such as, for example, vegetables, fruit, fish, meat, bones, and other food or materials used in the culinary industry or by routine knife users.

The present invention is seen to comprise parts or elements that include a handle 30, a blade 40, and a finger rest 50. See FIG. 1.

The handle 30, which may be made of any suitable material such as wood, steel, molded plastic or the like material, includes an elongated bottom handle portion with a surface hand-gripping member 32. The handle 30 comprises a handle top portion 31 with a handle top edge 31*a*, and a handle bottom portion 32, two opposing sides 33*a*, 33*b*, a handle proximal end 34 and a handle distal end 35. A centerline 36 extends along a substantially horizontal plane between said handle proximal end 34 and said handle distal end 35.

The blade 40, which can be of any desired shape or form, is made of stainless steel or the like material and comprises opposed first side vertical face 45 and second side vertical face 46. The blade also has a blade top portion 42 with a blade top edge 42*a*, longitudinally extending from a portion of said handle proximal end 34 and a lower cutting face 44. The elongated blade member 40 includes a distal end 48 and a blade proximal end 47 formed contiguously with said handle proximal end 34, and which may extend into the handle 30 at a blade/handle overlap portion 39 to secure the blade 40 to the handle 30. A blade centerline 49 extends along a substantially horizontal plane between said blade proximal end 47 and said distal end 48. The blade 40 is configured such that at least a portion of the handle centerline 36 and the blade centerline 49 overlap each other at the blade/handle overlap portion 39, and the blade proximal end 47 is connected to and extends from said handle distal end 35 or a portion thereof.

Figure 2:
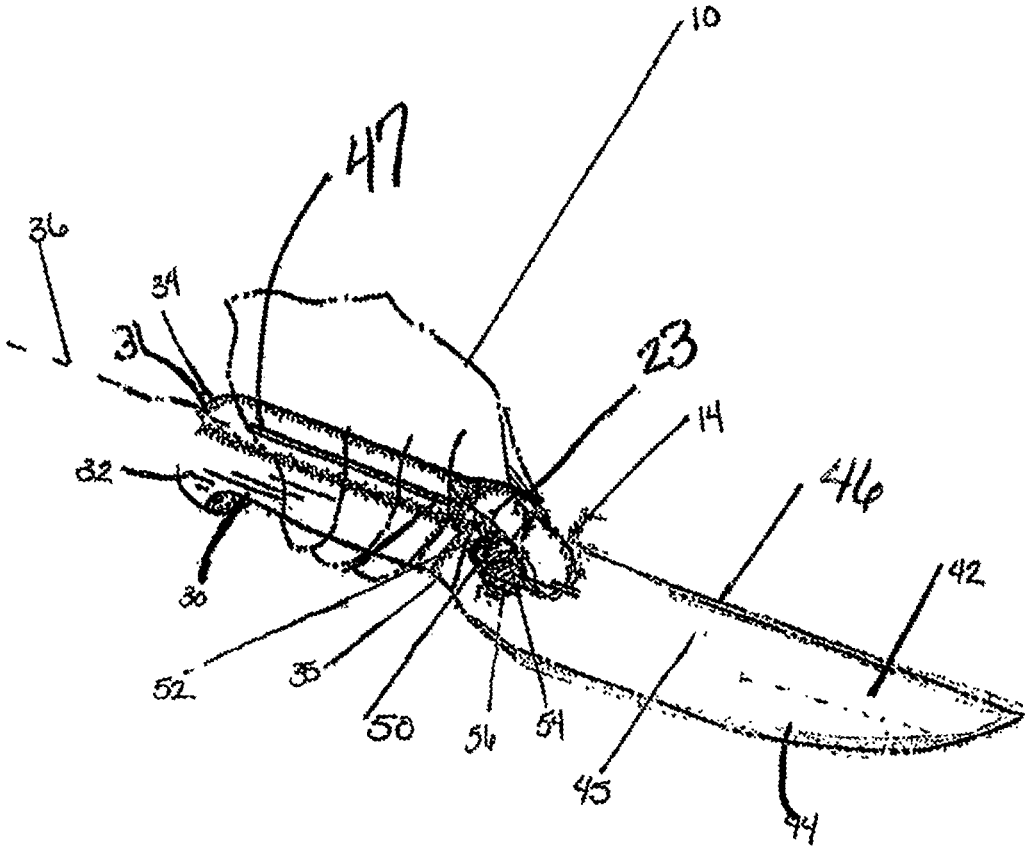
FIG. 2 is a perspective, elevational view that illustrates a preferred embodiment of the present invention, the knife being shown grasped by the hand of the intended user and a finger rest on the first side of the knife.
Figure 3:
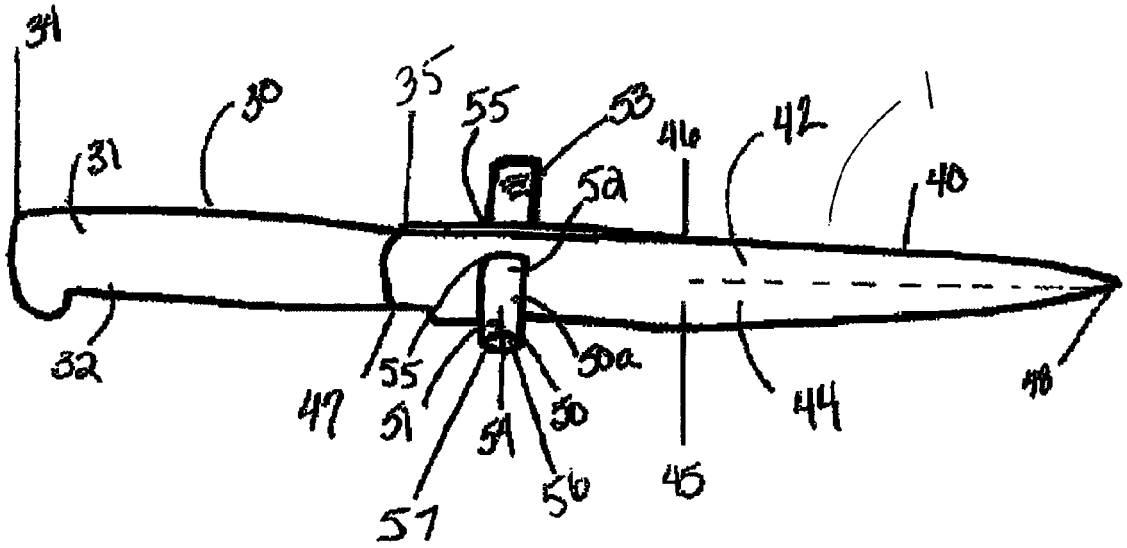
FIG. 3 is a perspective, elevational view that illustrates a preferred embodiment of the present invention with a finger rest on two sides of the knife.
Figure 4:
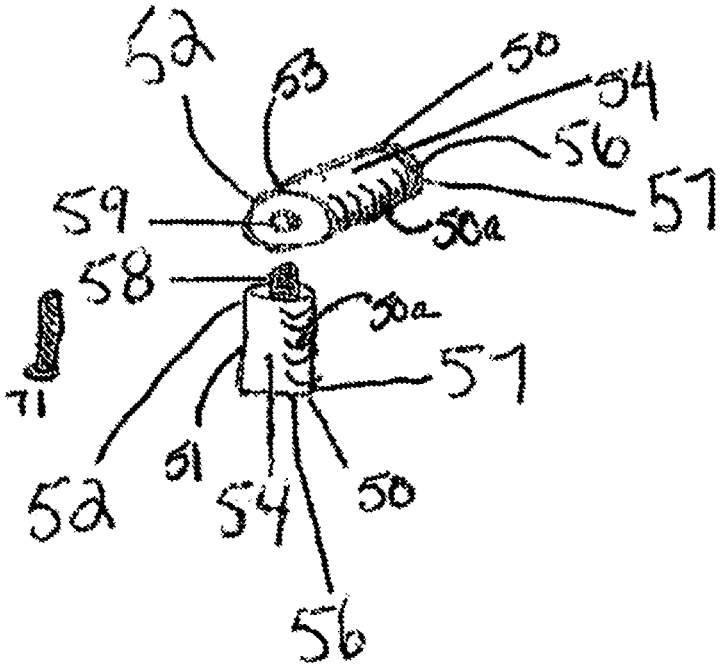
FIG. 4 is a perspective, elevational view that illustrates the connecting means of the finger rest.
Figure 5:
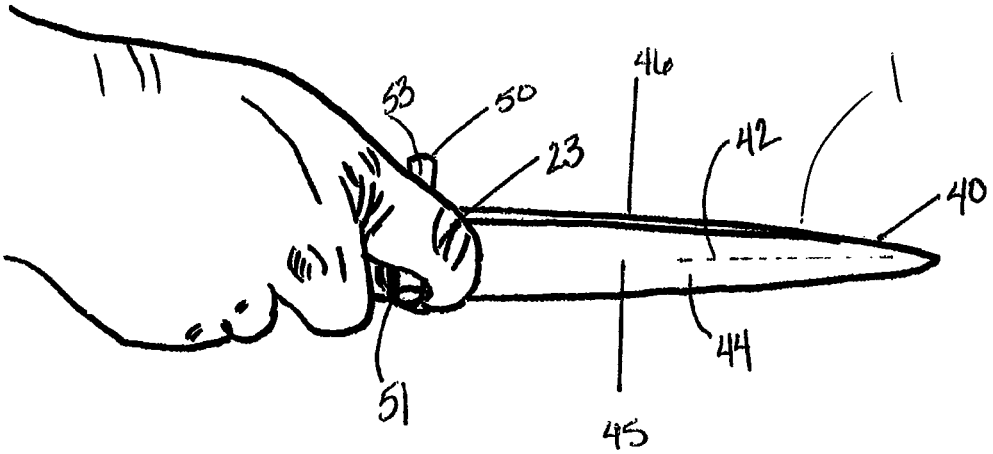
FIG. 5 is a perspective, top view of a preferred embodiment of the present invention with the hand of the intended user.

The invention also comprises a finger rest 50 having proximal 52 and distal ends 57, wherein the proximal end 52 of the finger rest is connected to the blade 40 at a connection point 55 proximate the proximal end 47 of said blade 40, and the finger rest 50 proximal 52 end and distal end 57 is separated by the specified length of said finger rest 50 that extends from the first side surface 45 of the blade 40, approximately perpendicular to the centerline 49 of blade 40. FIG. 1. The specified length of the finger rest extends beyond a maximum width of the handle and extends from the side of the blade proximate a location closer to the top portion of the blade as compared to the bottom, cutting edge of the blade. See FIGS. 1-3 and 5-7. As shown in FIG. 4, the finger rest 50 may be substantially tubular in shape, and comprises a top portion 54, a front portion 50*a* and a first side finger rest 51. The finger rest 50 further comprises a threaded male surface 58 and a threaded female receiving inset 59, which are configured to attach, remove, and relocate the finger rest 50 on the knife 1. In another possible embodiment, the finger rest 50 may also comprise a second side finger rest 53 that extends approximately perpendicular from the second side surface 46 of the blade 40 along the same horizontal plane as the first side finger rest 51. In this possible embodiment, the first side finger rest 51 and the second side finger rest 53 comprise threaded male and female surfaces on their proximal ends 52, and are configured to be joined together to form the finger rest 50 as shown in FIGS. 3-5, and as more fully described herein below. Note, that the first side finger rest 51 and the second side finger rest 53 are interchangeable. The finger rest 50 is configured and situated relative to the handle 30 and the blade 40 so as to minimize the pressure on the metacarpophalangeal joint 16 of the index finger 14 of one who uses said knife for cutting by resting and pressing down with the underside 15 of said index finger 14 on a top portion 54 of said finger rest 50.

The blade 40 proximal end 47 is connected to and extends from said distal end 35 of said handle 30 in such a manner so that said handle top edge 31*a* proximate said handle distal end and said blade top edge 42*a* at said blade proximal end 47, at said connection of said handle 30 and blade 40, together form what appears to be, from a side view of said knife 1, essentially a straight line that is parallel to said longitudinal centerline of said blade 40 and said handle 30 at said connection of said handle 30 and blade 40.

Figure 8:
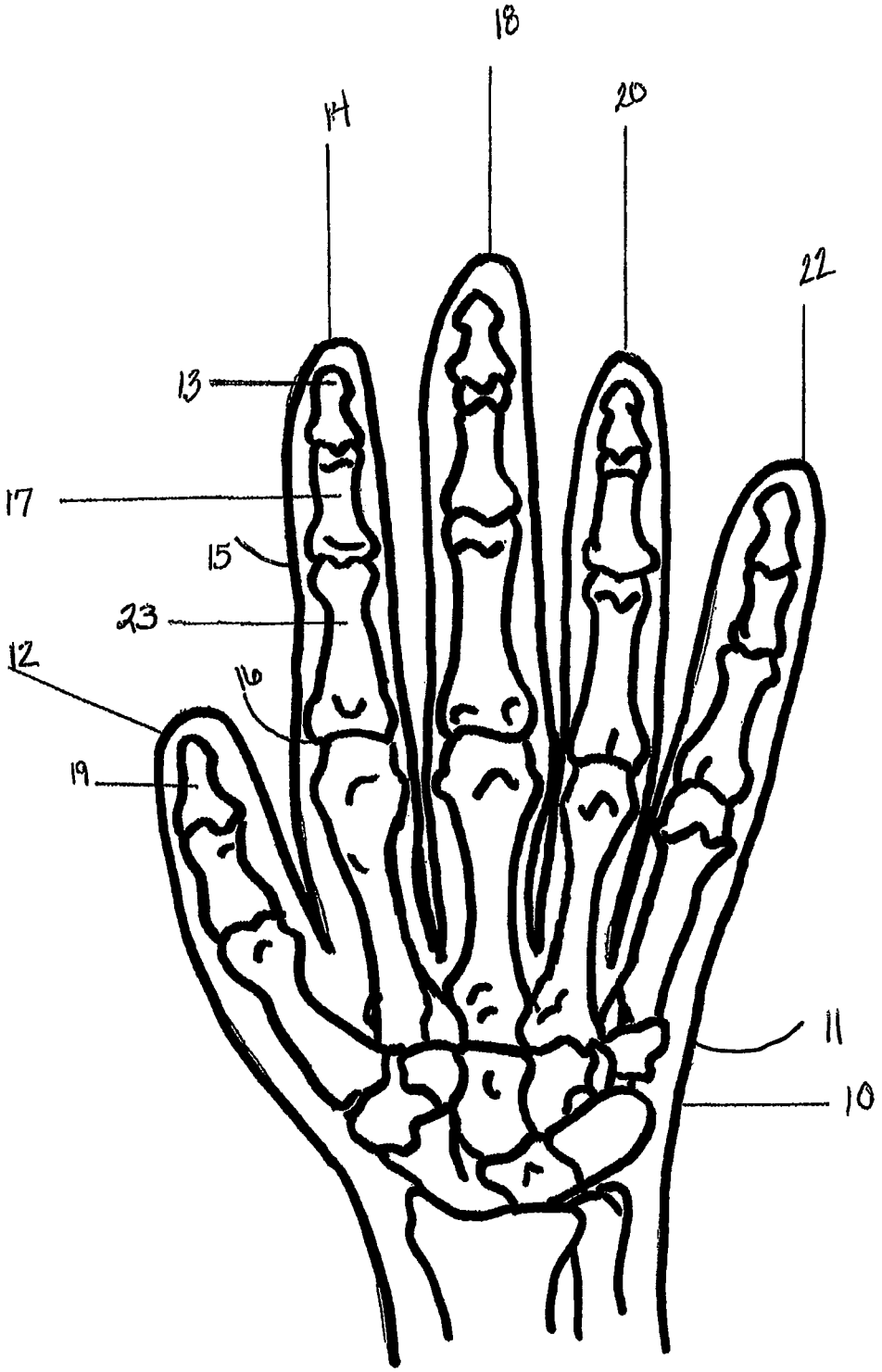
FIG. 8 is a perspective, elevational view of a user's hand and illustrating the various bones contained therein.

FIG. 8 shows the hand 10 of an intended user. The hand 10 includes a thumb 12, an index finger 14, a middle finger 18, a ring finger 20, and a small finger 22. FIG. 2 shows the handle 30 being grasped by a hand 10 of an intended user. The present invention as illustrated in FIGS. 1 and 2 also defines a top portion of the knife including the top portion of the handle 31 and blade 42, and a bottom portion of the handle 32 and blade 44 of said knife in FIGS. 1 and 2. As shown in FIGS. 2 and 5, the user's hand 10 grasps the handle 30 in the usual manner for cutting, by grasping the knife handle 30 with the palm of the hand 11, and the underside of the middle finger 18, ring finger 20 and small finger 22, which substantially wrap around the handle first side 33*a*, the handle second side 33*b* and the bottom of the handle 30. The distal phalange 19 of the user's thumb 12 is held adjacent to the opposing side of the handle. In this possible embodiment, the index finger 14 of the user extends toward the finger rest 50, and substantially wraps around the finger rest 50 such that the index finger underside 15 of the proximal phalange 23 is in substantial contact with the top portion of the tubular post 54 and the middle phalange 17 is in substantial contact with the top portion and/or front portion of the tubular post 54, 50*a* depending on the length of the user's finger and comfort of placement of the index finger by the user. In addition, the user also may keep the distal phalange 13 of the index finger 14 extended or wrap the index finger distal phalange 13 around the tubular post 50 for similar reasons depending on length and comfort placement. The extension of the user's index finger 14 upon the finger rest 50 relieves the pressure to the metacarpophalangeal joint that would otherwise be exerted on the joint during cutting. As previously described herein, relieving such pressure on the hand of a user decreases the stress on the metacarpophalangeal joints, which in turn decreases injury and pain, including arthritis.

Figure 7:
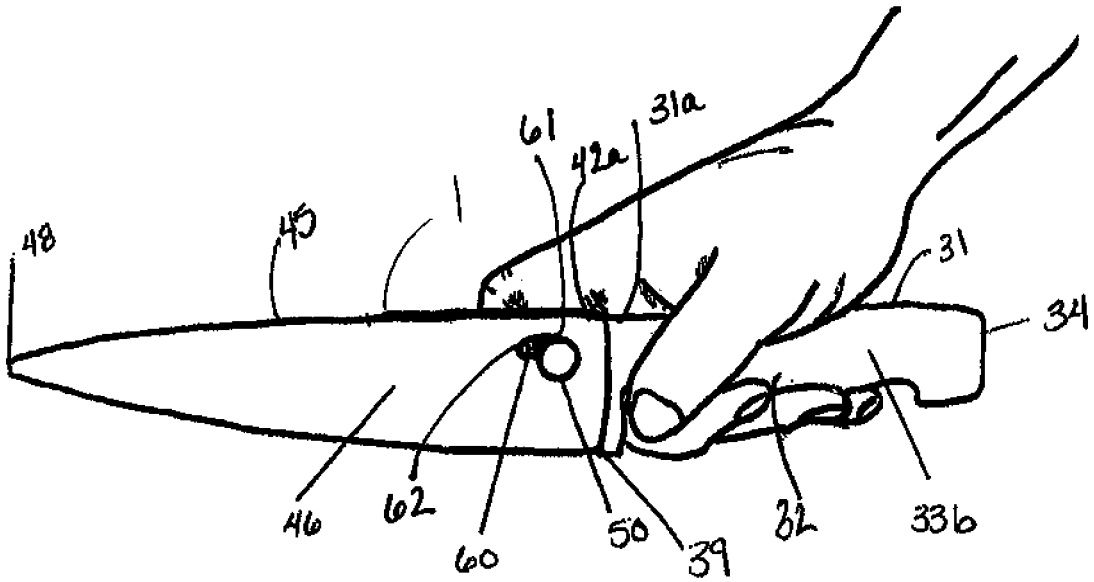
FIG. 7 is a perspective, side view of a preferred embodiment of a finger rest of the present invention with the hand of the intended user.

FIG. 3 shows the blade 40 of the knife 1 is configured with a finger rest 50 on the proximate portion of the blade 40. The shape of the finger rest 50 is substantially tubular and extends approximately perpendicular to the side 45, 46 of the blade 40. The finger rest 50 having proximal 52 and distal 57 ends that are separated by the specified length of said finger rest 50, a top 54 and a front portion 50*a* and wherein said proximal end 52 of said finger rest 50 is connected to said blade 40 at a connection point 55 proximate the proximal end 47 of said blade 40. In one embodiment, the finger rest 50 is featured having a tubular-shaped distal end surface 56 of the finger rest 50. FIGS. 5 and 7 show that the user can extend his or her index finger in place to rest and press on the top portion 54 of the finger rest 50 while grasping the knife handle 30 with the palm of the hand 11, and the underside of the middle finger 18, ring finger 20 and small finger 22, wrapping around one side 33*a*, 33*b* and the bottom of the handle 30. The distal phalange 19 of the user's thumb 12 is held adjacent to the opposing side of the handle. When using the knife 1, the finger rest 50 allows the user to substantially wrap his or her index finger around the top and front portion 54, 50*a* of the finger rest 50.

FIG. 2 illustrates a perspective view of a preferred embodiment of the knife 1 in which the finger rest 50 extends approximately perpendicular to the first blade side 45. The finger rest 50 having proximal 52 and distal 57 ends that are separated by the specified length of said finger rest 50, a top 54 and a front portion 50*a* and wherein said proximal end 52 of said finger rest 50 is connected to said blade 40 at a connection point 55 proximate the proximal end 47 of said blade 40, and wherein said specified length of said finger rest 50 is sufficient for substantially the entirety of the underside of the proximal phalange 23 of the index finger 14 of said one who is using said knife 1 to substantially fully rest on said top portion 54 of said finger rest 50. See also FIGS. 2, 3, and 8.

It should be understood that the finger rest 50 may also be positioned on the second blade side 46 of the knife 1, or on both the first blade side 45 and the second blade side 46 of the knife 1 as shown in FIG. 3. The positioning of the finger rest 50 on the first blade side 45 and/or the second blade side 46 of the blade 40 is subjective to the user of the knife, depending on which hand the user favors for performing a cutting motion and/or the cutting style that a user prefers. Some users may position the finger rest 50 to a particular side of the blade 40 depending on, among other things, whether the user is right handed or left handed.

FIGS. 3, 4, 5 and 6 show another possible embodiment of the present invention, wherein the blade 40 of the knife 1 is configured with a finger rest 50 on the proximal end 47 of the blade 40 at connection point 55, where the proximal end 52 of the finger rest 50 extends a specified length to the finger rest distal end 57 and is sufficient for substantially the entirety of the underside of the proximal phalange 23 of the index finger 14 of said one who is using said knife to substantially fully rest on said top portion 54 of said finger rest 50. In this possible embodiment, the finger rest 50 comprises a first side finger rest 51 and a second side finger rest 53, which each extend in opposite directions from the blade 40 and approximately perpendicular to the blade centerline 49 at each respective connection point 55. FIG. 5 shows this possible embodiment in use by a user in the same manner as the embodiment shown in FIGS. 1 and 2. The specified length of the finger rest extends beyond a maximum width of the handle and extends from the side of the blade proximate a location closer to the top portion of the blade as compared to the bottom, cutting edge of the blade. See FIGS. 1-3 and 5-7.

Figure 6:
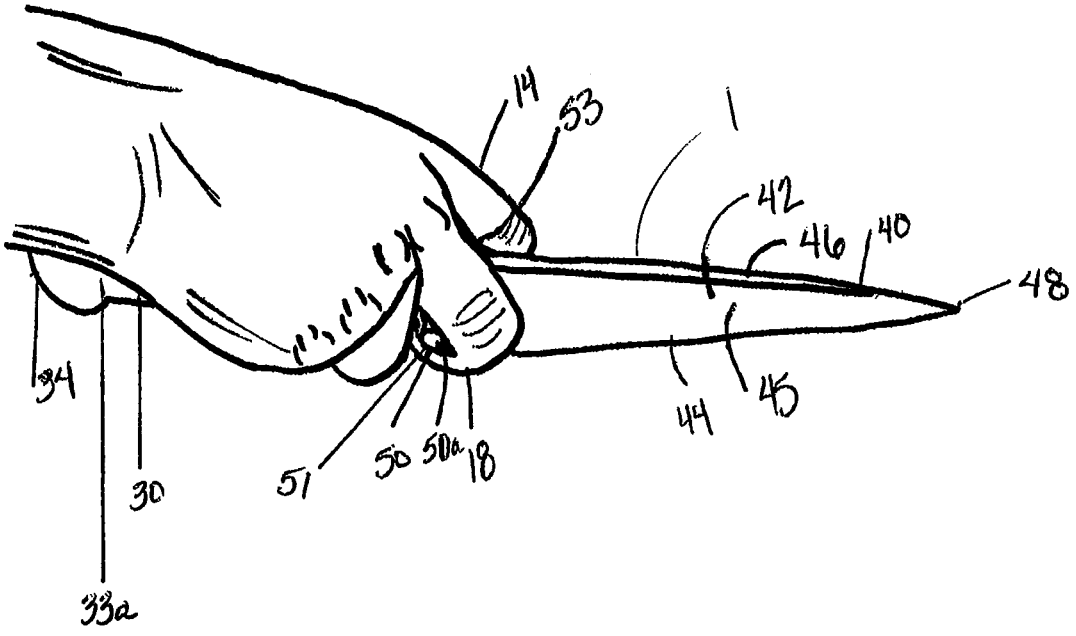
FIG. 6 is a perspective, top view of a preferred embodiment of a finger rest of the present invention with the hand of the intended user.

FIG. 6 shows that the finger rest 50 also allows the user to select a cutting style that engages both the index finger 14 and the middle finger 18. In this possible embodiment and for a right-handed user, the finger rest 50 may be configured to allow the user to substantially wrap his or her middle finger 18 around the top and front portion 54, 50*a* of the first side finger rest 51 that extends from the first blade side 45 of the blade 40, while the index finger 14 is substantially wrapped around the top and front portion 54, 50*a* of the second side finger rest 53 on the second blade side 46. In this manner, the first side finger rest 51 and the second side finger rest 53 allow the index finger and middle finger to straddle the handle 30 and blade overlap portion 39. The finger rest 50 allows the user to grasp the knife handle 30 with the palm of the hand 11, and the underside of the ring finger 20 and small finger 22, substantially wrapping around the first side of the handle 33*a*, the second side of the handle 33*b* and the bottom of the handle 30. The distal phalange 19 of the user's thumb 12 is held adjacent to the opposing side of the handle 30. For a left-handed user, in this possible embodiment, the finger rest 50 may be configured to allow the user to substantially wrap his or her index finger 14 around the top and front portion 54, 50*a* of the first side finger rest 51 that extends from the first blade side 45 of the blade 40, while the middle finger 18 is substantially wrapped around the top and front portion 54, 50*a* of the second side finger rest 53 on the second blade side 46. In this manner, the first side finger rest 51 and the second side finger rest 53 allow the index finger and middle finger to straddle the handle 30 and blade overlap portion 39.

In another possible embodiment, the blade 40 of the knife 1 may also comprise a slotted hole 60 that extends between the first blade side surface 45 and the second blade side surface 46 of the blade 40. The slot may have an elongated configuration and have a proximal 61 and distal end 62 along the longitudinal line of the blade 40. See FIG. 7. The finger rest 50 may also include two components 51 and 53, each of which extends substantially perpendicular to the first blade side 45 and second blade side 46. In one possible embodiment, the first side finger rest 51 and the second side finger rest 53 of the finger rest 50 may be joined together and connected through the slot 60. The slot 60 allows the finger rest 50 to be moveable and adjusted substantially horizontally along the blade 40 from the proximal slot end 61 to the distal slot end 62, thereby altering the placement of the connection point 55 of the finger rest 50 with the blade 40. The first side finger rest 51 and the second side finger rest 53 are able to lock together and also alter the location of the finger rest connection point 55.

For lexicon purposes, such slotted hole 60 may also be referred to herein as a hole, slot, or an elongated hole 60. The slot 60 provides a means for altering the position of the finger rest 50, thereby allowing the finger rest 50 to be located on the first blade side 45 of the knife or the second blade side 46 of the knife to accommodate left and right-handed cutting. The slot 60 also provides a means for altering the location of the finger rest 50 in connection with its position along the blade 40 at connection point 55. It should be understood that the slot 60 could be provided without allowing for means to alter the location of the finger rest 50 without departing from the scope of the present invention. In one possible embodiment, the slot 60 may be fabricated such that its dimensions are in the range of 0.25 inches wide and 0.50 inches in length, with additional curved edges extending beyond the 0.50 inches in length to round out the hole, slot or elongated hole 60. Another embodiment provides a permanent attachment of the finger rest 50 to the blade 40.

It should be understood that the finger rest 50 could be otherwise configured and sized for contacting more or less of the lateral surface 15 of the finger than that shown in FIG. 1. In addition, in at least some embodiments of the invention, the finger rest 50 has a different surface material or texture than that of an adjacent blade or handle. Additional layers of material may be added to the finger rest to provide cushion and comfort support to a user. It should be understood that other types of surface materials or textures could be used in connection with the finger rest without departing from the scope of the present invention.

In some instances, the user of the knife may utilize two hands in using the invention, such that the secondary hand, not in contact with the finger rest 50, is also positioned on the top portion 42 of the knife blade 40 to assist with pressing down or providing guidance or control over the knife.

It should be understood that the finger rest 50 could be provided with any suitable connecting, coupling or attachment means without departing from the scope of the present invention. For example, the finger rest 50 could be connected to the knife blade 40 by a connecting means of the releasable type or of the permanent type without departing from the scope of the invention. The finger rest 50 can be easily welded to adjoin the side surfaces of the blade 45 and/or 46, or could be affixed by other means.

Referring now more specifically to FIG. 4, there is shown the finger rest 50, which comprises a means of being attached to the blade 40 by way of a threaded male bolt screw 58 on the proximal end 52 of the first side finger rest 51, and a female receiving inset 59 on the proximal end 52 of the second side finger rest 53 of the finger rest 50. In one possible embodiment, the connecting means also could be a No. 8 hardware screw 71, or an Allen wrench set screw, among other things, and a No. 8-32$^{nd}$ tapered, threaded hole 59. It should be understood, however, that other connecting means may be utilized.

There are many suitable materials from which the present invention can be fabricated and all are considered to come within the scope of the present invention. After some experimentation, however, a high quality, Grade 303 stainless steel was selected from which to fabricate most preferred embodiments of the present invention. Grade 303 stainless steel is probably the most common steel used in fabricating many types of food processing and utility equipment. It should be appreciated by those skilled in the art that any similar material may also be used to fabricate the invention. A rod-styled product of Grade 303 stainless steel (approximately 0.5 inches) for the finger rest was found to be the most cost effective for the current application. The fabrication materials yield a knife that is easily cleaned and will provide years of effective use.

In a preferred embodiment, the finger rest 50 was fabricated such that the index finger rest is substantially circular with dimensions of approximately 0.5 inches in diameter. It should be understood, however, that the finger rest can be of many shapes, sizes, and diameters without departing from the scope of the present invention.

Experimentation was conducted to determine the optimal size and positioning of the finger rest 50 and provide for an adequate surface area and top portion 54 on which to rest the user's index finger in order to relieve pressure on the metacarpophalangeal joint 16 of the index finger 14 of one who is using the knife for cutting by resting and pressing down with the user's index finger on a top finger rest portion 54 of the knife. The preferred embodiment of the invention comprises a finger rest 50 having a substantial width or diameter of approximately 0.5 inches and 1 inch in length.

Advantages of the present invention include the index finger rest that is designed to minimize fatigue and the risk of repetitive stress-type injuries. The knife that is outfitted with the finger rest 50 relieves the pressure on the metacarpophalangeal joint of the index finger of one who is using the knife for cutting by resting and pressing down with the user's index finger on a top portion of the knife.

The proposed knife allows the user to have a lighter grip on the knife handle, which relieves excess strain on the hand. In addition, the knife is also specifically designed so as to allow the index finger of the user to be substantially extended separately at the metacarpophalangeal joint so that pressure on the joint is relieved and the joint is positioned according to its normal physiological flexed/natural alignment.

Furthermore, the proposed knife is designed so as to be easily cleaned through conventional cleaning operations. Yet, still furthermore, the proposed knife is designed so as to be able to be manufactured using conventional forms of manufacturing in conventional materials so as to provide a knife that will be economically feasible, long lasting, and relatively trouble-free in operation.

The foregoing is considered as illustrative only of the principles of the present invention. Further, since numerous modifications and changes will readily occur to those skilled in the art, it is not desired to limit the invention to the exact construction and operation shown and described herein. Accordingly, all suitable modifications and equivalents may be resorted to, falling within the scope of the invention that is illustratively set forth in the following representative claims to the present invention.

I claim:

1. A knife that relieves the pressure on the metacarpophalangeal joint of an index finger of one who is using said knife for cutting by resting and pressing down with the underside of said index finger on a top portion of said knife, said knife comprising:

a handle having a top portion, a bottom portion, two spaced-apart, opposing handle sides, a proximal and a distal end, wherein said handle top portion includes a handle top edge, wherein a handle longitudinal centerline is defined to extend between said handle proximal and distal ends, and wherein said spaced-apart, opposing handle sides having therebetween a distance that defines a width of said handle, a blade having a top portion, a bottom cutting edge portion, a first opposing blade side and a second opposing blade side, a proximal end and a distal end, wherein a blade longitudinal centerline is defined to extend between said blade proximal and distal ends, and wherein said knife is configured such that said blade proximal end is connected to and extends from said distal end of said handle in such a manner so that said handle top edge proximate said handle distal end and said blade top edge at said blade proximal end together form what appears to be, from a side view of said knife, an approximate straight line that is parallel to said handle longitudinal centerline, a first finger rest having a proximal end and a distal end, a top portion and a front portion, wherein said first finger rest proximal and distal ends are separated by a distance that defines a length of said first finger rest, and wherein said first finger rest proximal end is connected to a blade side chosen from said group consisting of said first opposing blade side and said second opposing blade side, and wherein said first finger rest proximal end is connected to said blade side at a first finger rest connection point that is situated both proximate said blade proximal end and above said blade longitudinal centerline so that said first finger rest connection point is situated within said top portion of said blade, wherein said length of said first finger rest is greater than said width of said handle, wherein said first finger rest connection point with said blade side includes a slot that extends between said first and second opposing blade sides, and wherein said slot is configured to allow the proximal end of said first finger rest to extend through said slot and to provide for an adjustable location of said first finger rest connection point with said blade side along said slot.

2. The knife as recited in claim 1, wherein said first finger rest is further configured so as to allow said index finger to wrap around said top and front portions of said first finger rest.

3. The knife as recited in claim 2, wherein said handle is configured so as to allow the underside of the middle, ring and small fingers to wrap around one side and the bottom of said handle while the distal phalange of the thumb is held adjacent the opposing side of said handle.

4. The knife as recited in claim 3, wherein said first finger rest is further configured to have a tubular shape that extends from said blade side so as form an intersection angle with said blade side and wherein said intersection angle is chosen from the group including a perpendicular angle and an approximately perpendicular angle.

5. The knife as recited in claim 1, wherein said first finger rest is further configured so as to allow the underside of the proximal and middle phalanges of said index finger to substantially rest and press on said top portion of said first finger rest.

6. The knife as recited in claim 1, wherein further comprising: a second finger rest having a proximal end and a distal end, a top portion and a front portion, wherein said first finger rest proximal and distal ends are separated by a distance that defines a length of said second finger rest, wherein said second finger rest proximal end is connected to said blade side that is opposite to the blade side to which said first finger rest is connected, and wherein said second finger rest proximal end is connected to said blade side at a second finger rest connection point that is situated both proximate said blade proximal end and above said blade longitudinal centerline so that said second finger rest connection point is situated within said top portion of said blade.

7. The knife as recited in claim 6, wherein said first and second finger rest are further configured so as to allow the index finger to wrap around the top and front portion of said second finger while the middle finger is wrapped around the top and front portion said first finger rest.

8. The knife as recited in claim 6, wherein said second finger rest is further configured to have a tubular shape that extend from said blade side so as form an intersection angle with said blade side and wherein said intersection angle is chosen from the group including a perpendicular angle and an approximately perpendicular angle.

9. A method of forming a knife that relieves the pressure on the metacarpophalangeal joint of an index finger of one who is using said knife for cutting by resting and pressing down with the underside of said index finger on a top portion of said knife, said method comprising the steps of:

providing a handle having a top portion, a bottom portion, two spaced-apart, opposing sides, a proximal and a distal end, wherein said handle top portion includes a handle top edge, wherein a handle longitudinal centerline is defined to extend between said handle proximal and distal ends, and wherein said spaced-apart, opposing sides having therebetween a distance that defines a width of said handle, providing a blade having a top portion, a bottom cutting edge portion, a first opposing blade side and a second opposing blade side, a proximal end and a distal end, wherein a blade longitudinal centerline is defined to extend between said blade proximal and distal ends, and wherein said knife is configured such that said blade proximal end is connected to and extends from said distal end of said handle in such a manner so that said handle top edge proximate said handle distal end and said blade top edge at said blade proximal end together form what appears to be, from a side view of said knife, an approximate straight line that is parallel to said handle longitudinal centerline, providing a first finger rest having a proximal end and a distal end, a top portion and a front portion, wherein said first finger rest proximal and distal ends are separated by a distance that defines a length of said first finger rest, and wherein said first finger rest proximal end is connected to a blade side chosen from said group consisting of said first opposing blade side and said second opposing blade side, and wherein said first finger rest proximal end is connected to said blade side at a first finger rest connection point that is situated both proximate said blade proximal end and above said blade longitudinal centerline so that said first finger rest connection point is situated within said top portion of said blade, wherein said length of said first finger rest is greater than said width of said handle, wherein said first finger rest connection point with said blade side includes a slot that extends between said first and second opposing blade sides, and wherein said slot is configured to allow the proximal end of said first finger rest to extend through said slot and to provide for an adjustable location of said first finger rest connection point with said blade side along said slot.

10. The method of forming a knife as recited in claim 9, wherein said first finger rest is further configured so as to allow said index finger to wrap around said top and front portion of said first finger rest.

11. The method of forming a knife as recited in claim 10, wherein said handle is configured so as to allow the underside of the middle, ring and small fingers to wrap around one side and the bottom of said handle while the distal phalange of the thumb is held adjacent the opposing side of said handle.

12. The method of forming a knife as recited in claim 10, wherein said first finger rest is further configured to have a tubular shape that extends from said blade side so as form an intersection angle with said blade side and wherein said intersection angle is chosen from the group including a perpendicular angle and an approximately perpendicular angle.

* * * * *